US010604914B2

(12) United States Patent
Moriki et al.

(10) Patent No.: US 10,604,914 B2
(45) Date of Patent: Mar. 31, 2020

(54) CONTROL SYSTEM FOR HYDRAULIC CONSTRUCTION MACHINE

(71) Applicant: HITACHI CONSTRUCTION MACHINERY CO., LTD., Tokyo (JP)

(72) Inventors: Hidekazu Moriki, Tokyo (JP); Ryu Narikawa, Tokyo (JP); Hiroaki Tanaka, Tsuchiura (JP); Hiroshi Sakamoto, Tsuchiura (JP); Yasutaka Tsuruga, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 21 days.

(21) Appl. No.: 15/780,313

(22) PCT Filed: Dec. 1, 2016

(86) PCT No.: PCT/JP2016/085685
§ 371 (c)(1),
(2) Date: May 31, 2018

(87) PCT Pub. No.: WO2017/094822
PCT Pub. Date: Jun. 8, 2017

(65) Prior Publication Data

US 2018/0355583 A1 Dec. 13, 2018

(30) Foreign Application Priority Data

Dec. 4, 2015 (JP) ..... 2015-237847

(51) Int. Cl.
*E02F 9/22* (2006.01)
*E02F 9/20* (2006.01)
*E02F 3/43* (2006.01)

(52) U.S. Cl.
CPC ..... *E02F 9/2235* (2013.01); *E02F 3/43* (2013.01); *E02F 3/437* (2013.01); *E02F 9/20* (2013.01);
(Continued)

(58) Field of Classification Search
CPC ..... E02F 9/2235; E02F 9/20; E02F 9/2012; E02F 9/2025; E02F 9/2029; E02F 9/2045; E02F 9/2296; E02F 3/43; E02F 3/437
See application file for complete search history.

(56) References Cited

U.S. PATENT DOCUMENTS

2016/0265187 A1* 9/2016 Baba ..... E02F 3/435
2016/0289928 A1* 10/2016 Kitajima ..... E02F 3/32
2017/0101761 A1* 4/2017 Wu ..... E02F 9/20

FOREIGN PATENT DOCUMENTS

JP 09-228426 A 9/1997
JP 09-291560 A 11/1997
(Continued)

OTHER PUBLICATIONS

International Preliminary Report on Patentability received in corresponding International Application No. PCT/JP2016/085685 dated Jun. 14, 2018.
(Continued)

*Primary Examiner* — Aaron L Troost
(74) *Attorney, Agent, or Firm* — Mattingly & Malur, PC

(57) ABSTRACT

The control system for the hydraulic construction machine includes: a hydraulic actuator; a work device driven by the hydraulic actuator; a hydraulic pump supplying a hydraulic fluid to the hydraulic actuator; a pump flow rate control section controlling the delivery flow rate of the hydraulic pump; a pump horsepower control section controlling the horsepower of the hydraulic pump; and a target surface distance acquiring section measuring or computing a target
(Continued)

surface distance that is the distance between a construction target surface on which the work device works and the work device. The pump flow rate control section is configured to perform control such that as the target surface distance decreases, the delivery flow rate decreases, and the pump horsepower control section is configured to perform control such that as the target surface distance decreases, the horsepower of the hydraulic pump increases.

2 Claims, 13 Drawing Sheets

(52) U.S. Cl.
CPC ..... *E02F 9/2012* (2013.01); *E02F 9/2025* (2013.01); *E02F 9/2029* (2013.01); *E02F 9/2045* (2013.01); *E02F 9/2296* (2013.01)

(56) References Cited

FOREIGN PATENT DOCUMENTS

| | | | |
|---|---|---|---|
| JP | 2001-248186 | A | 9/2001 |
| JP | 2010-203109 | A | 9/2010 |
| JP | 2014-012515 | A | 1/2014 |
| JP | 5791827 | B | 10/2015 |

OTHER PUBLICATIONS

International Search Report of PCT/JP2016/085685 dated Jan. 24, 2017.

* cited by examiner

CONTROL SYSTEM FOR HYDRAULIC CONSTRUCTION MACHINE

TECHNICAL FIELD

The present invention relates to a control system for a hydraulic construction machine.

BACKGROUND ART

In general, a hydraulic construction machine is equipped with a hydraulic actuator such as a hydraulic cylinder driving a front work device mounted thereon, an operation device operated by the operator, a hydraulic pump adjusting the delivery flow rate in accordance with the operation amount of the operation device, and a control valve driving a built-in directional control valve with an operation pilot pressure in accordance with the operation amount of the operation device to control the flow rate and direction of the hydraulic fluid supplied from a hydraulic pump to the hydraulic actuator.

When the hydraulic construction machine performs an operation such as excavating, there is generated inside the hydraulic actuator driving the front work device a load pressure in accordance with the excavating reaction force (excavating load), and the delivery pressure of the hydraulic pump is a value obtained by adding together this load pressure and the pressure loss of the hydraulic fluid line. In view of this, the hydraulic construction machine adopts a pump horsepower control in which as the delivery pressure of the hydraulic pump increases, the capacity of the hydraulic pump (delivery flow rate) is reduced to lower the horsepower of the hydraulic pump. The pump horsepower control suppresses deterioration in efficiency due, for example, to the application of an excessive load to the engine driving the hydraulic pump, an excessive increase in the delivery pressure of the hydraulic pump, and an increase in leak flow rate.

In connection with this hydraulic construction machine, there exists a construction machine locus control system converging the front device distal end to a target locus via a satisfactory path always matched with the human feeling independently of the operation amount of the operator (see, for example, Patent Document 1). This locus control system computes the position and attitude of the front device based on a signal from an angle sensor, and computes a target speed vector of the front device based on a signal from an operation lever device. The target speed vector is corrected so as to be directed to a point advanced forwards in the excavation progressing direction by a predetermined distance from a point in the target locus that is at a minimum distance from the front device distal end, and there is computed a target pilot pressure for driving a hydraulic control valve in correspondence with the corrected target speed vector. A proportional solenoid valve is controlled so as to generate the computed target pilot pressure.

Further, there exists a work device control system for a construction machine that aims to improve the position follow-up property of a work device operation cylinder and to secure predetermined finish accuracy even if the excavating load increases during a horizontally leveling operation or a slope face forming operation (see, for example, Patent Document 2). This work device control system constitutes a position follow-up feedback control system controlling a pilot pressure by a solenoid proportional valve so as to eliminate an error between the target position and target speed of each cylinder based on a signal from an operation lever and the actual position and speed of each cylinder based on information obtained from an angle sensor, and adjusts to increase the feedback gain and the feed forward gain by a lookup table in accordance with an increase in the cylinder load pressure.

PRIOR ART DOCUMENT

Patent Document

Patent Document 1: JP-1997-291560-A
Patent Document 2: JP-1997-228426-A

SUMMARY OF THE INVENTION

Problem to be Solved by the Invention

The construction machine locus control system disclosed in Patent Document 1 and the work device control system for the construction machine disclosed in Patent Document 2 eventually achieve their respective objects by controlling the operation pilot pressure drive-controlling a control valve constituting a conventional construction machine. Thus, in both examples, in the case where the excavating load increases, the above-mentioned pump horsepower control is exerted to reduce the delivery flow rate of the hydraulic pump, so that there is generated the possibility of a reduction in the drive speed of the hydraulic actuator.

As a result, in the construction machine locus control system disclosed in Patent Document 1, the speed of the hydraulic actuator, in particular, the speed of the arm cylinder mainly receiving the excavating load is lowered, and the speed balance between a plurality of hydraulic actuators (e.g., the arm cylinder, boom cylinder, and bucket cylinder) is deviated from the target value, with the result that there is generated the possibility of the locus being incapable of controlled as intended. For example, in the case where the excavating operation is being conducted through a combined operation of boom raising and arm crowding, when the excavating load, which is mainly applied to the arm, increases, the arm crowding speed is lowered, and the boom raising speed remains as it is, so that the balance in speed between the two is lost, resulting in deterioration in the finish accuracy.

In the work device control system for the construction machine disclosed in Patent Document 2, the position follow-up feedback control gain is adjusted to be increased in accordance with an increase in the cylinder load pressure. However, the delay in the operation of the hydraulic actuator accompanying the reduction in the delivery flow rate of the hydraulic pump is not always taken into consideration. Thus, in the case, in particular, where the operation speed is high, even if the operation pilot pressure is adjusted to be increased with respect to the increasing speed (changing ratio) of the excavating load generated due to a change in the nature of the soil, a reduction in the operation speed of the hydraulic actuator is unavoidable. Thus, there is generated the possibility of predetermined finish accuracy not being attained in the horizontally leveling operation and slop face forming.

The present invention has been made in view of the above problem. It is an object of the present invention to provide a control system for a hydraulic construction machine that helps to attain predetermined finish accuracy even if the excavating load increases during a horizontally leveling operation or a slope face forming operation.

Means for Solving the Problem

To achieve the above object, there is adopted, for example the construction as set forth in the appended claims. The present application includes a plurality of means for solving the problem, one example of which is a control system for a hydraulic construction machine, including: a hydraulic actuator; a work device including a boom, an arm, and a bucket driven by the hydraulic actuator; a hydraulic pump supplying a hydraulic fluid to the hydraulic actuator; a pump flow rate control section controlling a delivery flow rate of the hydraulic pump; a pump horsepower control section controlling a horsepower of the hydraulic pump; and a target surface distance acquiring section measuring or computing a target surface distance that is a distance between a construction target surface on which the work device works and the work device. The pump flow rate control section is configured to perform control such that as the target surface distance decreases, the delivery flow rate decreases, and the pump horsepower control section is configured to perform control such that as the target surface distance decreases, the horsepower of the hydraulic pump increases.

Effect of the Invention

According to the present invention, correction control is performed on the pump horsepower in accordance with the distance between the work device and the construction target surface, so that in the case where excavating is performed at a position close to the construction target surface, it is possible to attain predetermined finish accuracy even if the excavating load increases.

MODES FOR CARRYING OUT THE INVENTION

In the following, a control system for a hydraulic construction machine according to an embodiment of the present invention will be described with reference to the drawings.

Figure 1:
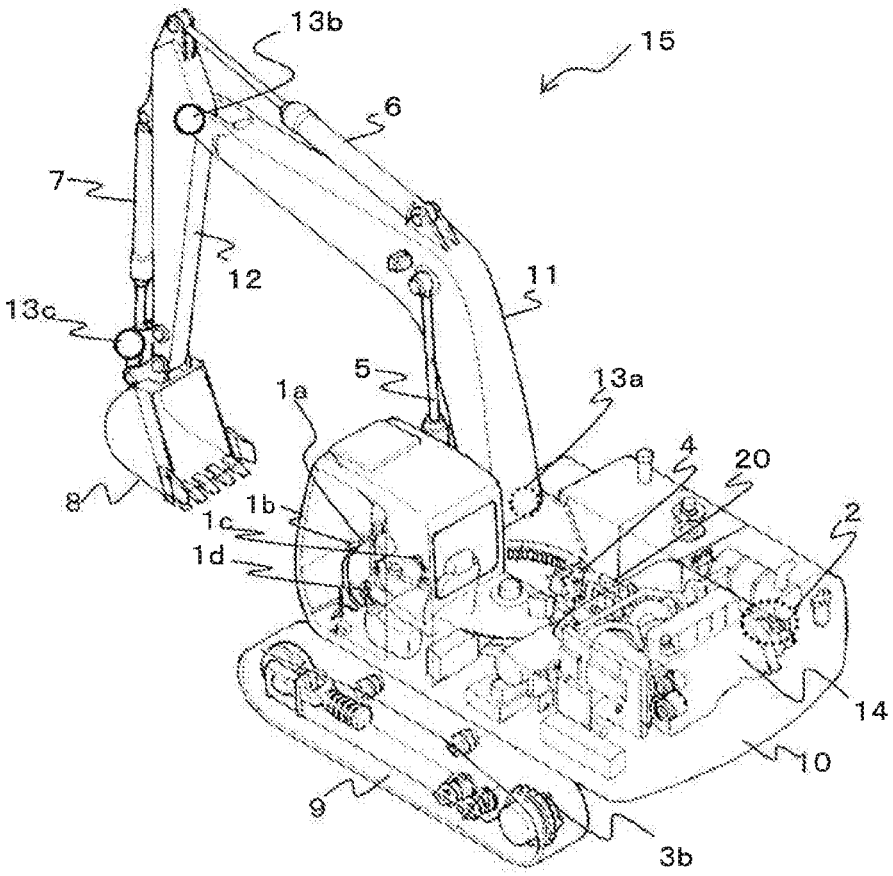
FIG. 1 is a perspective view of a hydraulic excavator equipped with a control system for a hydraulic construction machine according to an embodiment of the present invention.

FIG. 1 is a perspective view of a hydraulic excavator equipped with a control system for a hydraulic construction machine according to an embodiment of the present invention. As shown in FIG. 1, the hydraulic excavator is equipped with a lower track structure 9, an upper swing structure 10, and a work device 15. The lower track structure 9 has left and right crawler type track devices, which are driven by left and right traveling hydraulic motors 3*b* and 3*a* (of which solely the left-hand side motor 3*b* is shown). The upper swing structure 10 is swingably mounted on the lower track structure 9, and is driven to swing by a swing hydraulic motor 4. The upper swing structure 10 is equipped with an engine 14 as the prime mover, and a hydraulic pump device 2 driven by the engine 14.

The work device 15 is mounted to the front portion of the upper swing structure 10 so as to be capable of turning upwards. The upper swing structure 10 is equipped with a cab, in which there are arranged operation devices such as a traveling right-hand operation lever device 1*a*, a traveling left-hand operation lever device 1*b*, and a right-hand operation lever device 1*c* and a left-hand operation lever device 1*d* for commanding the operation of the work device 15 and the swinging operation.

The work device 15 is of a multi-joint structure having a boom 11, an arm 12, and a bucket 8. The boom 11 rotates vertically with respect to the upper swing structure 10 through expansion and contraction of a boom cylinder 5. The arm 12 rotates vertically and in the front-rear direction with respect to the boom 11 through expansion and contraction of an arm cylinder 6, and the bucket 8 rotates vertically and in the front-rear direction with respect to the arm 12 through expansion and contraction of a bucket cylinder 7.

Further, in order to calculate the position of the work device 15, there are provided an angle sensor 13*a* which is provided in the vicinity of the connection portion between the upper swing structure 10 and the boom 11 and which detects the angle of the boom 11 with respect to the horizontal plane, an angle sensor 13*b* which is provided in the vicinity of the connection portion between the boom 11 and the arm 12 and which detects the angle of the arm 12, and an angle sensor 13*c* which is provided in the vicinity of the arm 12 and the bucket 8 and which detects the angle of the bucket 8. Angle signals detected by these angle sensors 13*a* through 13*c* are inputted to a main controller 100 described below.

A control valve 20 serves to control the flow (flow rate and direction) of a hydraulic fluid supplied from a hydraulic pump device 2 to each of the actuators such as the boom cylinder 5, the arm cylinder 6, the bucket cylinder 7, and the left and right traveling hydraulic motors 3*b* and 3*a*.

Figure 2:
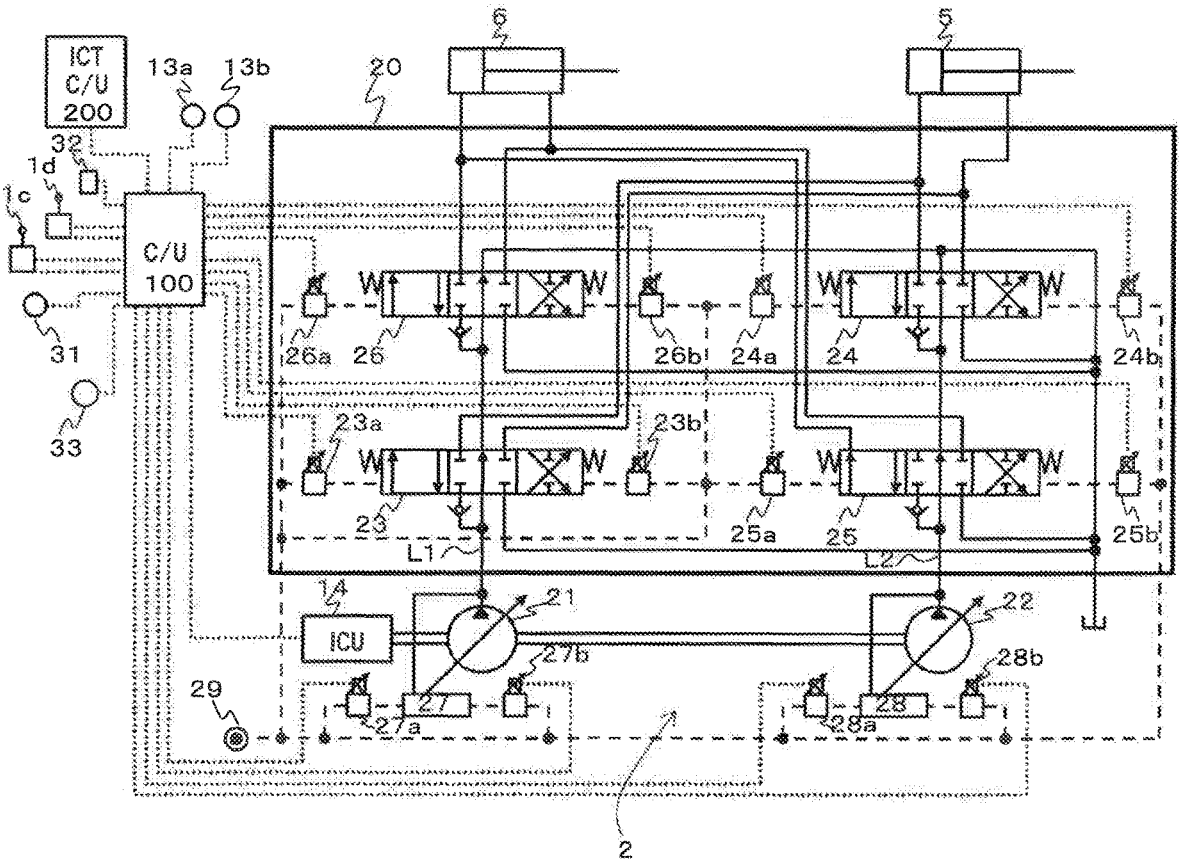
FIG. 2 is a schematic view of a hydraulic drive system of the hydraulic construction machine equipped with a control system for a hydraulic construction machine according to an embodiment of the present invention.

FIG. 2 is a schematic view of a hydraulic drive system of a hydraulic construction machine equipped with a control system for a hydraulic construction machine according to an embodiment of the present invention. To simplify the description, a construction equipped with solely the boom cylinder 5 and the arm cylinder 6 as the hydraulic actuators will be described, and a depiction and description of a main relief valve, a load check valve, a return circuit, a drain circuit, etc., which are not directly related to the embodiment of the present invention, will be left out.

In FIG. 2, the hydraulic drive system is equipped with the hydraulic pump device 2, the boom cylinder 5, the arm cylinder 6, the right-hand operation lever device 1*c*, the left-hand operation lever device 1*d*, the control valve 20, the main controller 100, and an information controller 200.

The hydraulic pump device 2 is equipped with a first hydraulic pump 21 and a second hydraulic pump 22. The first hydraulic pump 21 and the second hydraulic pump 22 are driven by an engine 14, and they deliver the hydraulic fluid respectively to a first pump line L1 and a second pump line L2. The first hydraulic pump 21 and the second hydraulic pump 22 are variable displacement hydraulic pumps. They are equipped with a first regulator 27 and a second regulator 28. The regulators 27 and 28 control the tilting position of a swash plate that is a displacement varying mechanism of the first hydraulic pump 21 and the second hydraulic pump 22, controlling the pump delivery flow rate.

The first regulator 27 and the second regulator 28 undergo positive tilting control by a pilot hydraulic fluid supplied thereto via solenoid proportional valves 27*a* and 28*a*. Further, the delivery pressure of the first hydraulic pump 21 and the delivery pressure of the second hydraulic pump 22 are respectively fed back to the first regulator 27 and the second regulator 28, and the absorption horsepower of these hydraulic pumps is controlled by these delivery pressures and the pilot hydraulic fluid supplied via the solenoid proportional valves 27*b* and 28*b*. This absorption horsepower control is performed to control hydraulic pump tilting such that a load determined by the hydraulic pump delivery pressure and the hydraulic pump tilting does not exceed the engine output power.

The control valve 20 is formed by two pump line systems consisting of a first pump line L1 and a second pump line L2. Connected to the first pump line L1 are a boom 1 directional control valve 23 and an arm 2 directional control valve 26, and the hydraulic fluid delivered from the first hydraulic pump 21 is supplied to the boom cylinder 5 and the arm cylinder 6. Similarly, connected to the second pump line L2 are an arm 1 directional control valve 25 and a boom 2 directional control valve 24, and the hydraulic fluid delivered from the second hydraulic pump 22 is supplied to the arm cylinder 6 and the boom cylinder 5.

The boom 1 directional control valve 23 is driven to operate by the pilot hydraulic fluid supplied to the operation section via solenoid proportional valves 23*a* and 23*b*. Similarly, the boom 2 directional control valve 24 is driven to operate by the pilot hydraulic fluid supplied to the operation section thereof via solenoid proportional valves 24*a* and 24*b*, the arm 1 directional control valve 25 is driven to operate by the pilot hydraulic fluid applied to the operation section thereof via solenoid proportional valves 25*a* and 25*b*, and the arm 2 directional control valve 26 is driven to operate by the pilot hydraulic fluid supplied to the operation section thereof via solenoid proportional valves 26*a* and 26*b*.

Using the pilot hydraulic fluid supplied from a pilot hydraulic fluid source 29 as the initial pressure, these solenoid proportional valves 23*a* through 28*b* output a secondary pilot hydraulic fluid reduced in pressure in accordance with a command current from the main controller 100 to the directional control valves 23 through 26 and the regulators 27 and 28.

The right-hand operation lever device 1*c* outputs a voltage signal to the main controller 100 as a boom operation signal or a bucket operation signal in accordance with the operation amount and the operational direction of the operation lever. Similarly, the left-hand operation lever device 1*d* outputs a voltage signal to the main controller 100 as a swing operation signal or an arm operation signal in accordance with the operation amount and the operational direction of the operation lever.

The main controller 100 inputs a dial signal from an engine control dial 31, a boom operation amount signal transmitted from a right-hand operation lever device 1*c*, an arm operation amount signal transmitted from the right-hand operation lever device 1*c*, a mode setting signal transmitted from a mode setting switch 32 as a setting device, a horsepower adjustment signal transmitted from a horsepower adjustment dial 33 as a setting device, a construction target surface position signal transmitted from the information controller 200, and a boom angle signal and an arm angle signal transmitted from angle sensors 13*a* and 13*b* serving as position acquiring means, and, in accordance with these input signals, transmits an engine speed command to an engine controller (not shown) controlling the engine 14, and outputs command signals driving the solenoid proportional valves 23*a* through 28*b*. The computation performed by the information controller 200 is not directly related to the present invention, so a description thereof will be left out.

The engine control dial 31, the mode setting switch 32, and the horsepower adjustment dial 33 are arranged inside the cab. The mode setting switch 32 makes it possible to make a selection as to which of energy saving property and speed follow-up property a priority is to be given to in the operation of the hydraulic construction machine. For example, selection is possible from among the following: 1: normal mode, 2: horsepower increase mode, 3: locus control mode, and 4: horsepower increase+locus control mode. As described in detail below, the horsepower adjustment dial 33 allows further adjustment of a target horsepower signal computed.

Figure 3:
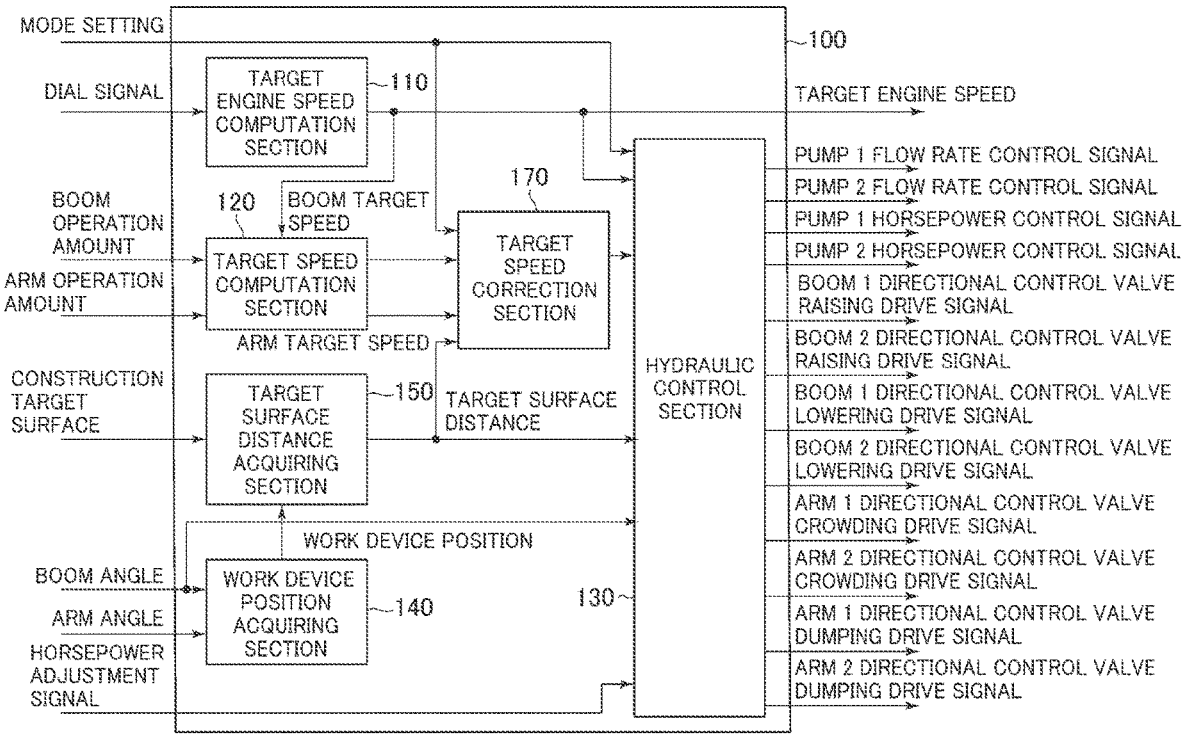
FIG. 3 is a conceptual drawing illustrating the construction of a main controller constituting a control system for a hydraulic construction machine according to an embodiment of the present invention.
Figure 4:
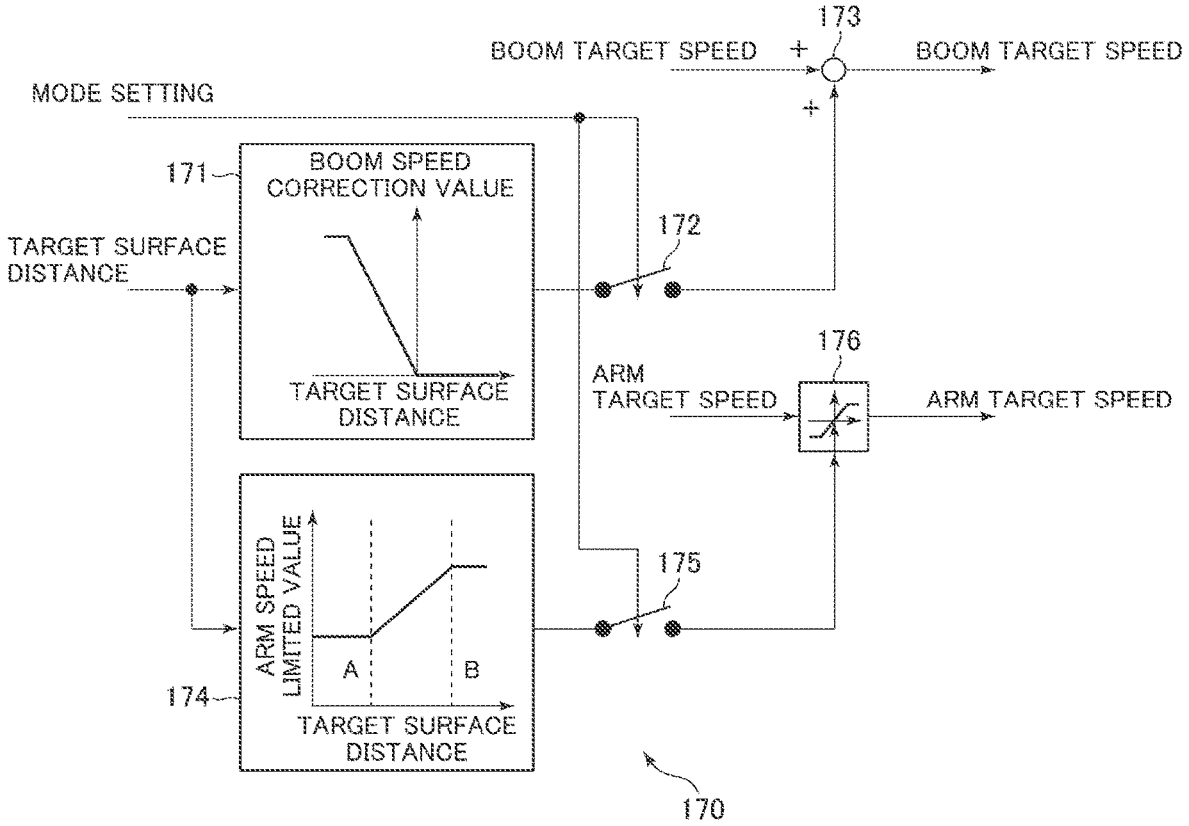
FIG. 4 is a control block diagram illustrating an example of computation of a target speed correction section of a main controller constituting a control system for a hydraulic construction machine according to an embodiment of the present invention.

Next, the main controller 100 constituting the control system of the hydraulic construction machine according to an embodiment of the present invention will be described with reference to the drawings. FIG. 3 is a conceptual drawing illustrating the construction of a main controller constituting a control system for a hydraulic construction machine according to an embodiment of the present invention. FIG. 4 is a control block diagram illustrating an example of computation of a target speed correction section of a main controller constituting a control system for a hydraulic construction machine according to an embodiment of the present invention.

As shown in FIG. 3, the main controller 100 is equipped with a target engine speed computation section 110, a target speed computation section 120, a hydraulic control section 130, a work device position acquiring section 140, a target surface distance acquiring section 150, and a target speed correction section 170.

The target engine speed computation section 110 inputs the dial signal from the engine control dial 31, and computes a targets engine speed in accordance with the input signal, outputting the target engine speed to the target speed computation section 120 and the hydraulic control section 130.

The target speed computation section 120 inputs the boom operation amount signal from the right-hand operation lever device 1*c*, the arm operation amount signal from the left-hand operation lever device 1*d*, and the target engine speed signal from the target engine speed computation section 110, and computes the boom target speed and the arm target speed in accordance with the input signals, outputting them to the target speed correction section 170. The larger the boom operation amount in the boom raising direction, the higher the boom target speed in the positive direction, and the larger the boom operation amount in the boom lowering direction, the higher the boom target speed in the negative direction. Similarly, the larger the arm operation amount in the arm crowding direction, the higher the arm target speed in the positive direction, and the larger the arm operation amount in the arm dumping direction, the higher the arm target speed in the negative direction.

The work device position acquiring section 140 inputs the boom angle signal and the arm angle signal from the angle sensors 13*a* and 13*b*, and computes the distal end position of the bucket 8 by using geometrical information on the boom 11 and the arm 12 previously set in accordance with the input signals, outputting it to the target surface distance acquiring section 150 as a work device position signal. Here, the work device position is computed, for example, as a point in a coordinate system fixed to the hydraulic construction machine. The work device position, however, is not restricted thereto. It may be computed as a plurality of point groups in which the configuration of the work device 15 is taken into consideration. Further, the same computation as that in the construction machine locus control system disclosed in Patent Document 1 may be performed.

The target surface distance acquiring section 150 inputs a construction target surface position signal transmitted from the information controller 200, and a work device position signal from the work device position acquiring section 140, and, based on the input signals, computes the distance between the work device 15 and the construction target surface (hereinafter referred to as the target surface distance), outputting it to the hydraulic control section 130 and the target speed correction section 170. Here, the construction target surface position is given, for example, as two points in a coordinate system fixed to the hydraulic construction machine. The construction target surface position, however, is not restricted thereto. It may also be given as two points in a global coordinate system. In this case, however, it is necessary to effect coordinate conversion to the coordinate system as that of the work device. In the case where the work device position is computed as a point group, the target surface distance may be computed by using the point closest to the construction target surface position. Further, the same computation as that of the minimum distance Δh of the locus control system of the construction machine disclosed in Patent Document 1 may be performed. In the case where no construction target surface position signal is transmitted from the information controller 200, the target surface distance acquiring section 150 outputs the target surface distance as zero.

The target speed correction section 170 inputs a mode setting signal transmitted from the mode setting switch 32, a boom target speed signal and an arm target speed signal from the target speed computation section 120, and a target surface distance signal from the target surface distance acquiring section 150, and computes a corrected boom target speed signal and a corrected arm target speed signal obtained by correcting the target speed signals, outputting them to the hydraulic control section 130. The computation performed by the target speed correction section 170 will be described below in detail.

The hydraulic control section 130 inputs the mode setting signal transmitted from the mode setting switch 32, the target engine speed signal from the target engine speed computation section 110, the corrected boom target speed signal and the corrected arm target speed signal from the target speed correction section 170, the target surface distance signal from the target surface distance acquiring section 150, the boom angle signal with respect to the horizontal plane from the angle sensor 13*a*, and the horsepower adjustment signal from the horsepower adjustment dial 33, and, based on the input signals, computes a boom 1 directional control valve raising drive signal, a boom 1 directional control valve lowering drive signal, a boom 2 directional control valve raising drive signal, a boom 2 directional control valve lowering drive signal, an arm 1 directional control valve crowding drive signal, and arm 1 directional control valve dumping drive signal, an arm 2 directional control valve crowding drive signal, an arm 2 directional control valve dumping drive signal, a pump 1 directional flow rate control signal, a pump 1 horsepower control signal, a pump 2 flow rate control signal, and a pump 2 horsepower control signal, outputting drive signals each driving the corresponding solenoid proportional valves 23*a*, 23*b*, 24*a*, 24*b*, 25*a*, 25*b*, 26*a*, 26*b*, 27*a*, 27*b*, 28*a*, and 28*b*.

An example of the computation conducted by the target speed correction section 170 will be described with reference to FIG. 4. The target speed correction section 170 is equipped with a boom speed correction value table 171, a conditional connection section 172, an addition section 173, an arm speed limited value table 174, a conditional connection section 175, and a restriction section 176.

The boom speed correction value table 171 inputs the target surface distance signal, and computes a boom speed correction value signal in accordance with the target surface distance signal by a previously set table, outputting it to the conditional connection section 172. The conditional connection section 172 effects switching of the connection section using the mode setting signal transmitted from the mode setting switch 32 as the condition. When it is in the connection state, an input signal is outputted. More specifically, when the mode set is one of the following: 3: locus control mode, or 4: horsepower increase+locus control mode, the connection section is placed in the connection state, and a boom speed correction value signal is outputted to the addition section 173.

The addition section 173 inputs the boom speed correction value signal and the boom target speed signal before correction, and outputs the added value as the corrected boom target speed. The boom speed correction value table 171 is set such that the boom speed correction value is positive when the target surface distance is equal to or less than 0. As a result, when the work device 15 is about to get deep into the construction target surface, the boom raising speed is increased, so that it is possible to prevent the work device 15 from getting too deep into the construction target surface. However, the boom target speed may be corrected through the vector direction correction as described in Patent Document 1.

The arm speed limited value table 174 inputs the target surface distance signal, and computes an arm speed limited value signal in accordance with the target surface distance signal by a previously set table, outputting it to the conditional connection section 175. The conditional connection section 175 effects switching of the connection section using the mode setting signal transmitted from the mode setting switch 32 as the condition. When it is in the connection state, an input signal is outputted. More specifically, when the mode set is one of the following: 3: locus control mode, or 4: horsepower increase+locus control mode, the connection section is placed in the connection state, and the arm speed limited value signal is outputted to the restriction section 176.

The restriction section 176 inputs the arm speed limited value signal and the arm target speed signal before correction, and performs limitation correction such that the absolute value of the arm target speed signal before correction is equal to or less than the arm speed limited value, outputting it as the corrected arm target speed. The arm speed limited value table 174 is set such that when the target surface distance is equal to or more than B, the arm speed limited value is the maximum speed of arm crowding (or arm dumping) and that when the target surface distance is equal to or less than A, the arm speed limited value is the minimum value. Here, the target surface distance A is an index for deciding to give top priority to the finish accuracy over the operation speed and operational efficiency. It is desirable for the target surface distance A to be set to a distance of construction accuracy equal to or better than that required for the operation.

The target surface distance B is an index for determining the interference of the locus control of the work device 15. It is set based on the time it takes for the work device 15 to reach the construction target surface through the arm operation. For example, it is set to a distance equal to or more than the distance obtained by multiplying the maximum value of the speed of the work device 15 due to arm crowding by the control cycle of the main controller 100. As a result, the arm speed is limited in the vicinity of the construction target surface, and the locus of the work device 15 becomes easier to control.

Figure 5:
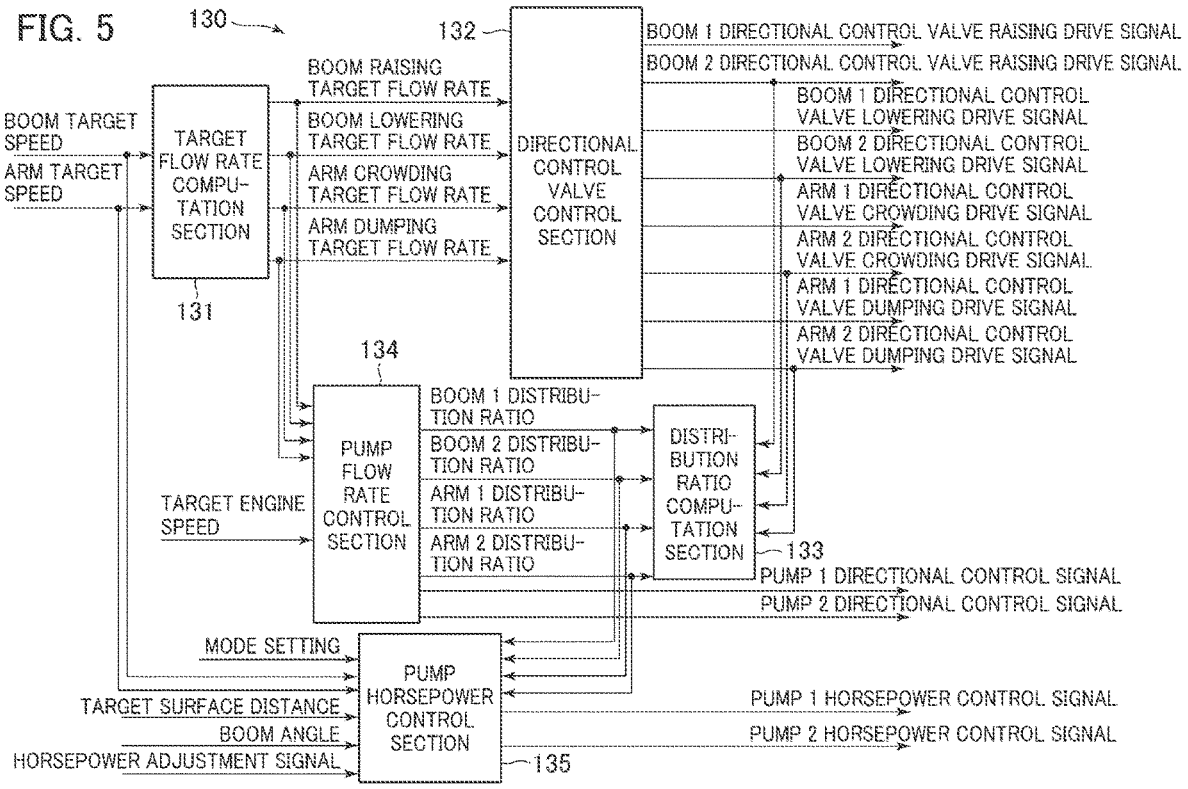
FIG. 5 is a conceptual drawing illustrating the construction of a hydraulic control section of a main controller constituting a control system for a hydraulic construction machine according to an embodiment of the present invention.
Figure 6:
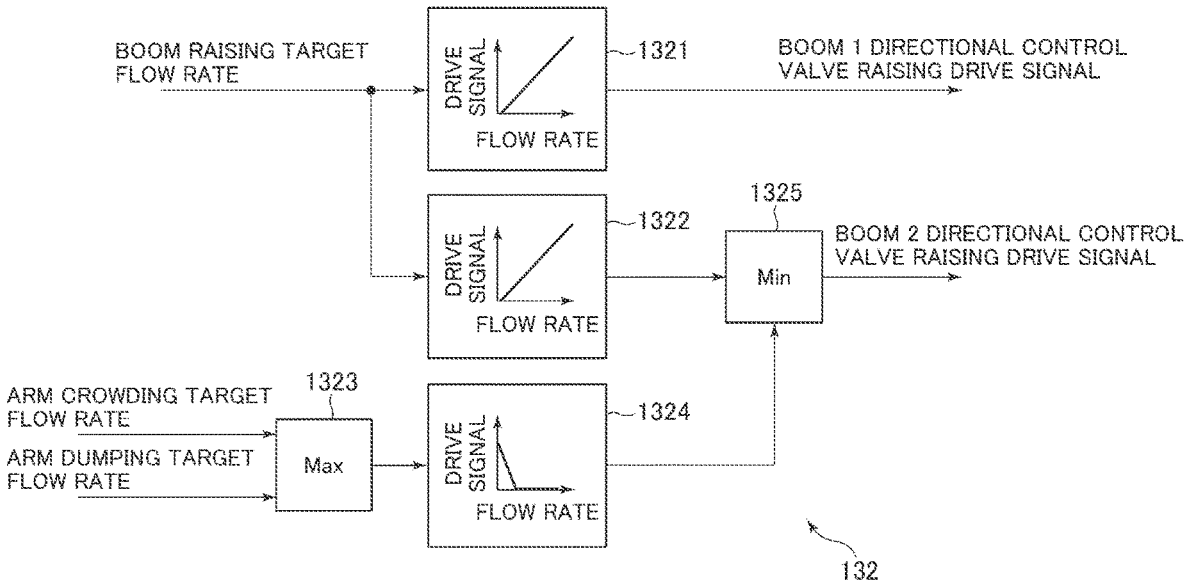
FIG. 6 is a control block diagram illustrating an example of computation of a directional control valve control section of a main controller constituting a control system for a hydraulic construction machine according to an embodiment of the present invention.
Figure 7:
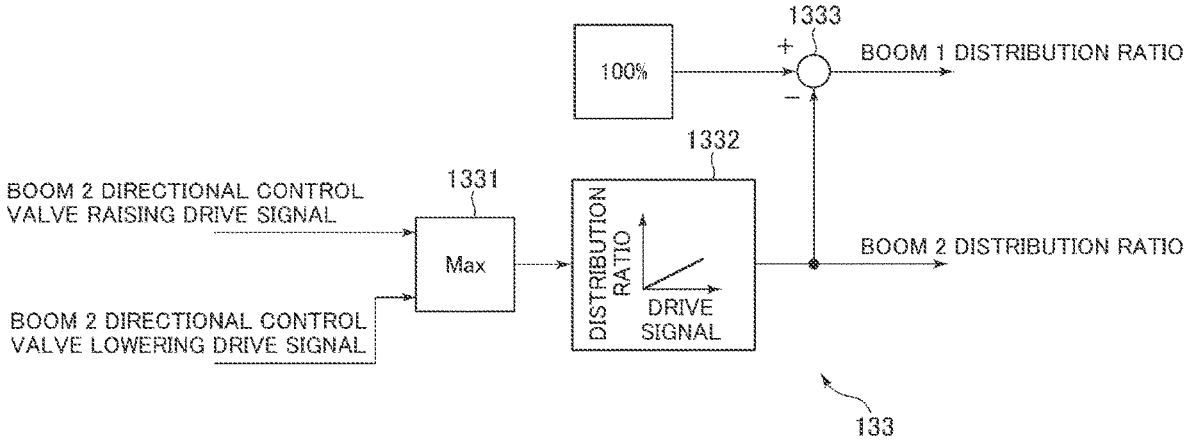
FIG. 7 is a control block diagram illustrating an example of computation of a distribution ratio computation section of a main controller constituting a control system for a hydraulic construction machine according to an embodiment of the present invention.
Figure 8:
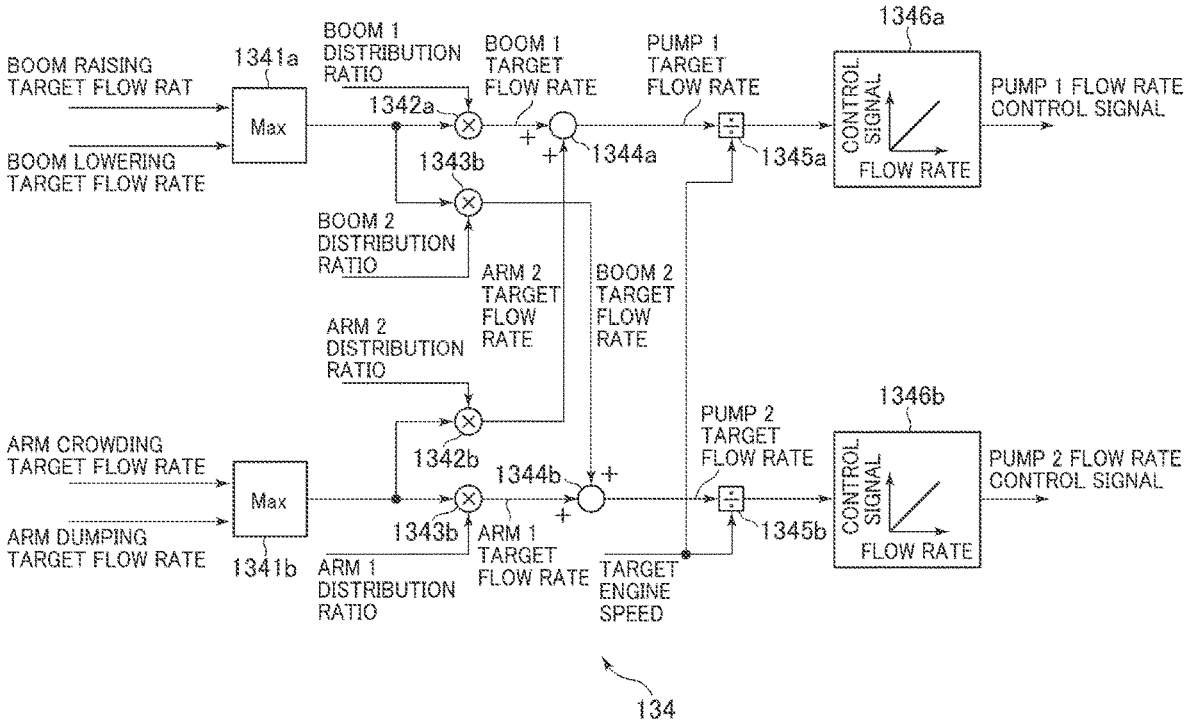
FIG. 8 is a control block diagram illustrating an example of computation of a pump flow rate control section of a main controller constituting a control system for a hydraulic construction machine according to an embodiment of the present invention.
Figure 9:
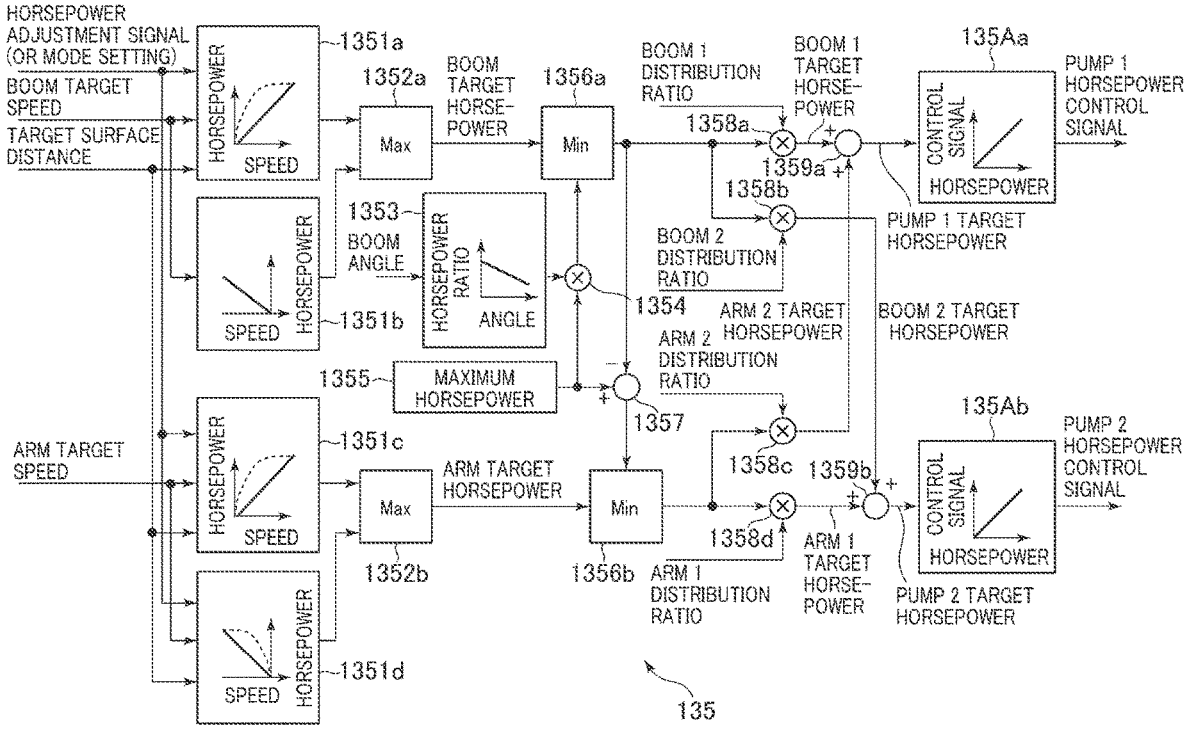
FIG. 9 is a control block diagram illustrating an example of computation of a pump horsepower control section of a main controller constituting a control system for a hydraulic construction machine according to an embodiment of the present invention.

Next, the hydraulic control section 130 will be described in detail with reference to the drawings. FIG. 5 is a conceptual drawing illustrating the construction of the hydraulic control section of the main controller constituting the control system for the hydraulic construction machine according to an embodiment of the present invention, FIG. 6 is a control block diagram illustrating an example of computation of a directional control valve control section of the main controller constituting the control system for the hydraulic construction machine according to an embodiment of the present invention, FIG. 7 is a control block diagram illustrating an example of computation of a distribution ratio computation section of the main controller constituting a control system for a hydraulic construction machine according to an embodiment of the present invention, FIG. 8 is a control block diagram illustrating an example of computation of a pump flow rate control section of the main controller constituting the control system for the hydraulic construction machine according to an embodiment of the present invention, and FIG. 9 is a control block diagram illustrating an example of computation of a pump horsepower control section of the main controller constituting the control system for the hydraulic construction machine according to an embodiment of the present invention.

As shown in FIG. 5, the hydraulic control section 130 of the main controller 100 is equipped with a target flow rate computation section 131, a directional control valve control section 132, a distribution ratio computation section 133, a pump flow rate control section 134, and a pump horsepower control section 135.

The target flow rate computation section 131 inputs the corrected boom target speed signal and the corrected arm target speed signal from the target speed correction section 170, and multiplies the corrected boom target speed signal by the effective area of the boom cylinder 5 to compute a boom raising target flow rate signal and a boom lowering target flow rate signal. In the case where the corrected boom target speed signal is positive, solely the boom raising target flow rate signal is computed, and in the case where the boom target speed signal is negative, solely the boom lowering target flow rate signal is computed. Similarly, by multiplying the corrected arm target speed signal by the effective area of the arm cylinder 6, the arm crowding target flow rate signal and the arm dumping target flow rate signal are computed. In the case where the arm target speed signal is positive, solely the arm crowding target flow rate signal is computed, and in the case where the arm target speed signal is negative, solely the arm dumping target flow rate signal is computed.

The directional control valve control section 132 inputs the boom raising target flow rate signal, the boom lowering target flow rate signal, the arm crowding target flow rate signal, and the arm dumping target flow rate signal from the target flow rate computation section 131, and computes drive signals for the boom 1 directional control valve 23, the boom 2 directional control valve 24, the arm 1 directional control valve 25, and the arm 2 directional control valve 26. An example of the computation conducted by the directional control valve control section 132 will be described with reference to FIG. 6. For the operations of boom raising, boom lowering, arm crowding, and arm dumping, the computation means adopted are similar to each other. Thus, here, solely the boom raising operation will be described, and a description of the other operation will be left out.

The directional control valve control section 132 is equipped with a boom 1 directional control valve raising drive signal table 1321, a boom 2 directional control valve raising drive signal table 1322, a maximum value selection section 1323, a boom 2 directional control valve raising drive limitation table 1324, and a minimum value selection section 1325.

The boom 1 directional control valve raising drive signal table 1321 and the boom 2 directional control valve raising drive signal table 1322 inputs the boom raising target flow rate signal calculated by the target flow rate computation section 131, and computes a boom 1 directional control valve raising drive signal and a boom 2 directional control valve raising drive signal in accordance with the boom raising target flow rate signal by a previously set table. From the boom 1 directional control valve raising drive signal table 1321, a drive signal is outputted to the solenoid proportional valve 23*a*.

The maximum value selection section 1323 inputs the arm crowding target flow rate signal and the arm dumping target flow rate signal calculated by the target flow rate computation section 131, and selects the maximum of the two, outputting it to the boom 2 directional control valve raising drive limitation table 1324. The boom 2 directional control valve raising drive limitation table 1324 computes a boom 2 directional control valve raising drive limitation signal in accordance with the input arm target flow rate signal by a previously set table, and outputs it to the minimum value selection section 1325.

The minimum value selection section 1325 inputs the boom 2 directional control valve raising drive signal calculated by the boom 2 directional control valve raising drive signal table 1322 and the boom 2 directional control valve raising drive signal calculated by the boom 2 directional control valve raising drive limitation table 1324, and selects the minimum value of the two, thereby limiting the boom 2 directional control valve raising drive signal to a level equal to or less than the boom 2 directional control valve raising drive signal limited value. From the minimum value selection section 1325, a drive signal is outputted to the solenoid proportional valve 24*a*. As a result, for example, in the case where boom raising and arm crowding are combined with each other, the boom 2 directional control valve 24 remains closed, and the hydraulic fluid is supplied to the boom cylinder 5 solely from the first hydraulic pump 21.

At the directional control valve control section 132, a computation similar to that described above is performed also on boom lowering, arm crowding, and arm dumping, so that, in the case, for example, arm crowding and boom raising are combined with each other, the arm 2 directional control valve raising drive signal is outputted to the solenoid proportional valve 26*a* from the minimum value selection section 1325. Due to this operation, the arm 2 directional control valve 26 remains closed, and the hydraulic fluid is supplied to the arm cylinder 6 solely from the second hydraulic pump 22.

Referring back to FIG. 5, the distribution ratio computation section 133 inputs the boom 2 directional control valve raising drive signal, the boom 2 directional control valve lowering drive signal, the arm 2 directional control valve crowding drive signal, and the arm 2 directional control valve dumping drive signal from the directional control valve control section 132, and computes a boom 1 distribution ratio signal, a boom 2 distribution ratio signal, an arm 1 distribution ratio signal, and an arm 2 distribution ratio signal, outputting these signals to the pump flow rate control section 134 and the pump horsepower control section 135. An example of the computation performed by the distribution ratio computation section 133 will be described with reference to FIG. 7. The computation methods for the boom and the arm are similar to each other, so, here, solely the computation on the boom will be described, and a description of the computation on the arm will be left out.

The distribution ratio computation section 133 is equipped with a maximum value selection section 1331, a boom distribution ratio table 1332, and a subtraction section 1333.

The maximum value selection section 1331 inputs the boom 2 directional control valve raising drive signal and the boom 2 directional control valve lowering drive signal calculated by the directional control valve control section 132, and selects the maximum value of the two, outputting it to the boom distribution ratio table 1332. The distribution ratio table 1332 computes a boom 2 distribution ratio in accordance with the input drive signal by a previously set table, and outputs it to the subtraction section 1333, the pump flow rate control section 134, and the pump horsepower control section 135.

The subtraction section 1333 inputs a fixed value 100% signal and a boom 2 distribution ratio signal, and outputs a value obtained by subtracting the boom 2 distribution ratio signal from the fixed value 100% signal to the pump flow rate control section 134 and the pump horsepower control section 135 as a boom 1 distribution ratio signal.

Referring back to FIG. 5, the pump flow rate control section 134 inputs the boom raising target flow rate signal, the boom lowering target flow rate signal, the arm crowding target flow rate signal, and the arm dumping target flow rate signal from the target flow rate computation section 131, the target engine speed signal from the target engine speed computation section 110, the boom 1 distribution ratio signal, the boom 2 distribution ratio signal, the arm 1 distribution ratio signal, and the arm 2 distribution ratio signal from the distribution ratio computation section 133, and computes a pump 1 flow rate control signal and a pump 2 flow rate control signal, driving the solenoid proportional valves 27*a* and 28*a* for positive tilting control to control the first regulator 27 and the second regulator 28. An example of the computation performed by the pump flow rate control section 134 will be described with reference to FIG. 8.

The pump flow rate control section 134 is equipped with a maximum value selection section 1341*a*, a first multiplication section 1342*a*, a second multiplication section 1343*a*, a first addition section 1344*a*, a first division section 1345*a*, and a pump 1 flow rate control signal table 1346*a*. Further, the pump flow rate control section 134 is equipped with a maximum value selection section 1341*b*, a third multiplication section 1342*b*, a fourth multiplication section 1343*b*, a second addition section 1344*b*, a second division section 1345*b*, and a pump 2 flow rate control signal table 1346*b*.

The maximum value selection section 1341*a* inputs the boom raising target flow rate signal and the boom lowering target flow rate signal, and selects the maximum value of the two, outputting it to the first multiplication section 1342*a* and the second multiplication section 1343*a*. The first multiplication section 1342*a* multiplies the boom 1 distribution ratio signal by the boom target flow rate signal to calculate the boom 1 target flow rate signal, and outputs it to the first addition section 1344*a*. Similarly, the second multiplication section 1343*a* multiplies the boom 2 distribution ratio signal by the boom target flow rate signal to calculate the boom 2 target flow rate signal, and outputs it to the second addition section 1344*b*.

The maximum value selection section 1341*b* inputs the arm crowding target flow rate signal and the arm dumping target flow rate signal, and selects the maximum value of the two, outputting it to the third multiplication section 1342*b* and the fourth multiplication section 1343*b*. The third multiplication section 1342*b* multiplies the arm 2 distribution ratio signal by the arm target flow rate signal to calculate the arm 2 target flow rate signal, outputting it to the first addition section 1344*a*. Similarly, the fourth multiplication section 1343*b* multiplies the arm 1 distribution ratio signal by the arm target flow rate signal to calculate the arm 1 target flow rate signal, outputting it to the second addition section 1344*b*.

The first addition section 1344*a* adds the boom 1 target flow rate signal and the arm 2 target flow rate signal together to calculate the pump 1 target flow rate signal, and outputs it to the first division section 1345*a*. The first division section 1345*a* divides the pump 1 target flow rate signal by the input target engine speed signal to calculate the flow rate signal, and outputs it to the pump 1 flow rate control signal table 1346*a*. The pump 1 flow rate control signal table 1346*a* computes a pump 1 flow rate control signal in accordance with the input flow rate signal by a previously set table, and drives the solenoid proportional valve 27*a* for position tilting control.

The second addition section 1344*b* adds the arm 1 target flow rate signal and the boom 2 target flow rate signal together to calculate the pump 2 target flow rate signal, and outputs it to the second division section 1345*b*. The second division section 1345*b* divides the pump 2 target flow rate signal by the input target engine speed signal to calculate the flow rate signal, and outputs it to the pump 2 flow rate control signal table 1346*b*. The pump 2 flow rate control signal table 1346*b* computes a pump 2 flow rate control signal in accordance with the input flow rate signal, and drives the solenoid proportional valve 28*a* for positive tilting control.

In the computation up to this stage, in the case where a combined operation of the boom and the arm is performed, the boom 1 distribution ratio and the arm 1 distribution ratio are substantially 100%, and the boom 2 distribution ratio and the arm 2 distribution ratio are substantially 0%, so that the target flow rate for the boom is supplied from the first hydraulic pump 21, and the target flow rate for the arm is supplied from the second hydraulic pump 22.

Referring back to FIG. 5, the pump horsepower control section 135 inputs the boom target speed signal and the arm target speed signal from the target speed correction section 170, the target surface distance signal from the target surface distance acquiring section 150, the boom angle signal with respect to the horizontal plane from the angle sensor 13*a*, the mode setting signal transmitted from the mode setting switch 32, the horsepower adjustment signal from the horsepower adjustment dial 33, and the boom 1 distribution ratio signal, the boom 2 distribution ratio signal, the arm 1 distribution ratio signal, and the arm 2 distribution ratio signal from the distribution ratio computation section 133, and computes the pump 1 horsepower control signal and the pump 2 horsepower control signal, driving the solenoid proportional valves 27*b* and 28*b* for horsepower control to control the first regulator 27 and the second regulator 28. An example of the computation conducted by the pump horsepower control section 135 will be described with reference to FIG. 9.

The pump horsepower control section 135 is equipped with a boom raising target horsepower table 1351*a*, a boom lowering target horsepower table 1351*b*, a maximum value selection section 1352*a*, a boom maximum horsepower ratio table 1353, a first multiplication section 1354, a signal generation section 1355 setting a maximum horsepower signal, a first minimum value selection section 1356*a*, a subtraction section 1357, a second multiplication section 1358*a*, a third multiplication section 1358*b*, a first addition section 1359*a*, and a pump 1 horsepower control signal table 135Aa. Further, the pump horsepower control section 135 is equipped with an arm crowding target horsepower table 1351*c*, an arm dumping target horsepower table 1351*d*, a maximum value selection section 1352*b*, a second minimum value selection section 1356*b*, a fourth multiplication section 1358*c*, a fifth multiplication section 1358*d*, a second addition section 1359*b*, and a pump 2 horsepower control signal table 135Ab.

The boom raising target horsepower table 1351*a* inputs the horsepower adjustment signal, the boom target speed signal, and the mode setting signal, and computes a boom raising target horsepower signal in accordance with the boom target speed signal by a previously set table, and outputs it to the maximum value selection section 1352*a*. The boom lowering target horsepower table 1351*b* inputs the boom target speed signal, and computes a boom lowering target horsepower signal in accordance with the boom target speed signal by a previously set table, and outputs it to the maximum value selection section 1352*a*. The maximum value selection section 1352*a* selects the maximum value of the input signals, and outputs it to the first minimum value selection section 1356*a* as the boom target horsepower signal.

Similarly, using the arm crowding target horsepower table 1351*c* and the arm dumping target horsepower table 1351*d*, an arm crowding target horsepower signal and an arm dumping target horsepower signal are each computed from the arm target speed signal, and the maximum value is selected by the maximum value selection section 1352*b*, and is outputted to the second minimum value selection section 1356*b* as the arm target horsepower signal.

Here, the boom raising target horsepower table 1351*a*, the arm crowding target horsepower table 1351*c*, and the arm dumping target horsepower table 1351*d* correct the target horsepower signal calculated from the target speed signal in accordance with the horsepower adjustment signal (or the mode setting) and the target surface distance, and output the result. The method of correcting the target horsepower performed in accordance with the horsepower adjustment signal (or the mode setting) and the target surface distance signal will be described in detail below.

The boom maximum horsepower ratio table 1353 inputs the boom angle signal with respect to the horizontal plane, and computes a boom maximum horsepower ratio signal in accordance with the boom angle signal by a previously set table, and outputs it to the first multiplication section 1354. The first multiplication section 1354 multiplies the signal from the signal generation section 1355 setting the maximum horsepower with which the hydraulic fluid is supplied from the hydraulic pump by the boom maximum horsepower ratio signal to calculate the boom maximum horsepower signal, and outputs it to the first minimum value selection section 1356*a*. The first minimum value selection section 1356*a* corrects the boom target horsepower that is the input signal to a level equal to or less than the boom maximum horsepower signal, and outputs the result to the subtraction section 1357, the second multiplication section 1358*a*, and the third multiplication section 1358*b*.

The subtraction section 1357 subtracts the corrected boom target horsepower signal from the signal of the signal generation section 1355 setting the maximum horsepower, and outputs the result to the second minimum value selection section 1356*b* as the arm maximum horsepower signal. The second minimum value selection section 1356*b* corrects the arm target horsepower signal that is the input signal to a level equal to or less than the arm maximum horsepower signal, and outputs the result to the fourth multiplication section 1358*c* and the fifth multiplication section 1358*d*.

Here, the boom maximum horsepower ratio table 1353 is set such that the smaller the boom angle signal with respect to the horizontal plane, the larger the boom maximum horsepower ratio signal. Thus, as in the case of slope face cutting-up operation, in the case where the boom angle (and the boom cylinder stroke) is small and where the excavating reaction force is exerted so as to hinder the boom raising, it is possible to give priority to the boom in distributing the horsepower. As in the case of slope face cutting-down, in the case where the boom angle (and the boom cylinder stroke) is large and where the excavating reaction force is exerted so as to promote the boom raising, it is possible to give priority to the arm in distributing the horsepower.

The second multiplication section 1358*a* multiplies the boom 1 distribution ratio signal by the boom target horsepower signal to calculate the boom 1 target horsepower, and outputs it to the first addition section 1359*a*. The third multiplication section 1358*b* multiplies the boom 2 distribution ratio signal by the boom target horsepower signal to calculate the boom 2 target horsepower, and outputs it to the second addition section 1359*b*. Similarly, the fourth multiplication section 1358*c* multiplies the arm 2 distribution ratio signal by the arm target horsepower signal to calculate the arm 2 target horsepower signal, and outputs it to the first addition section 1359*a*. The fifth multiplication section 1358*d* multiplies the arm 1 distribution ratio signal by the arm target horsepower signal to calculate the arm 1 target horsepower signal, and outputs it to the second addition section 1359*b*.

The first addition section 1359*a* adds the boom 1 target horsepower signal and the arm 2 target horsepower signal together to calculate the pump 1 target horsepower signal, and outputs it to the pump 1 horsepower control signal table 135Aa. Similarly, the second addition section 1359*b* adds the arm 1 target horsepower signal and the boom 2 target horsepower signal together to calculate the pump 2 target horsepower signal, and outputs it to the pump 2 horsepower control signal table 135Ab.

The pump 1 horsepower control signal table 135Aa computes a pump 1 horsepower control signal in accordance with the input pump 1 target horsepower signal by a previously set table, and drives the solenoid proportional valve 27*b* for horsepower control. Similarly, the pump 2 horsepower control signal table 135Ab computes a pump 2 horsepower control signal in accordance with the input pump 2 target horsepower signal by a previously set table, and drives the solenoid proportional valve 28*b* for horsepower control.

Figure 10:
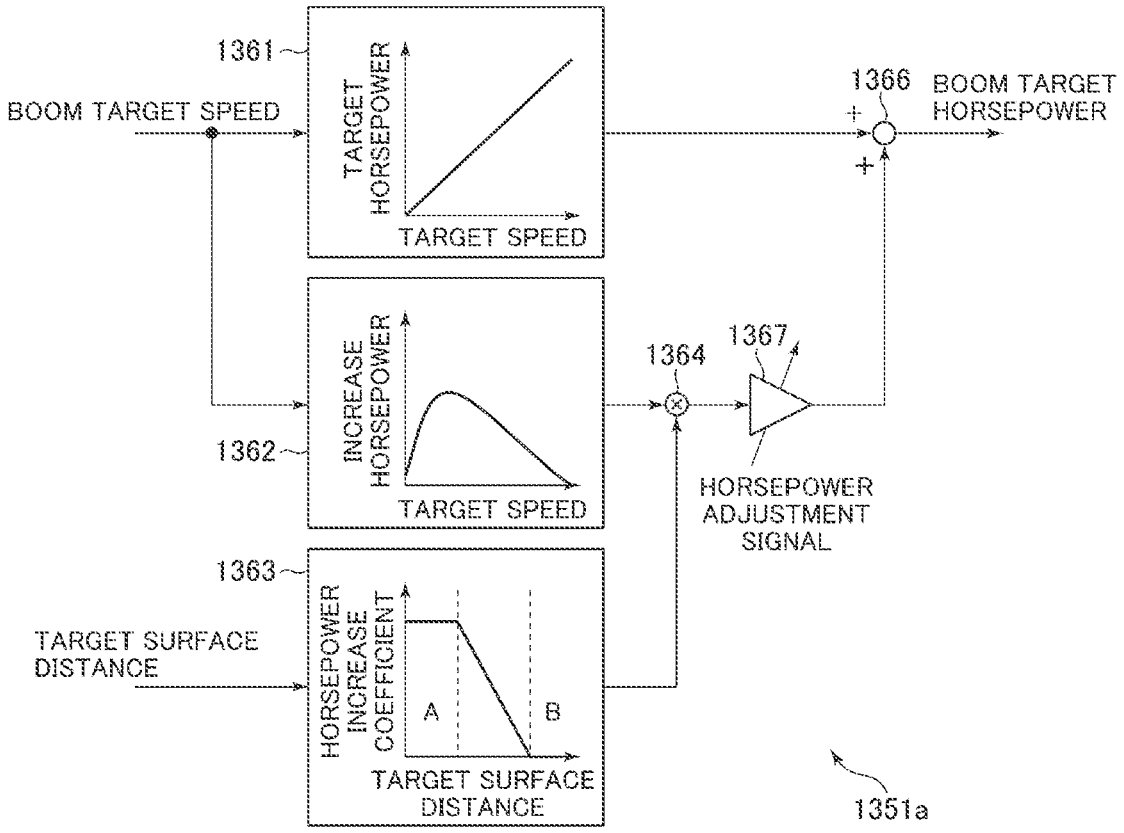
FIG. 10 is a control block diagram illustrating an example of computation of a boom raising target horsepower table of a main controller constituting a control system for a hydraulic construction machine according to an embodiment of the present invention.
Figure 11:
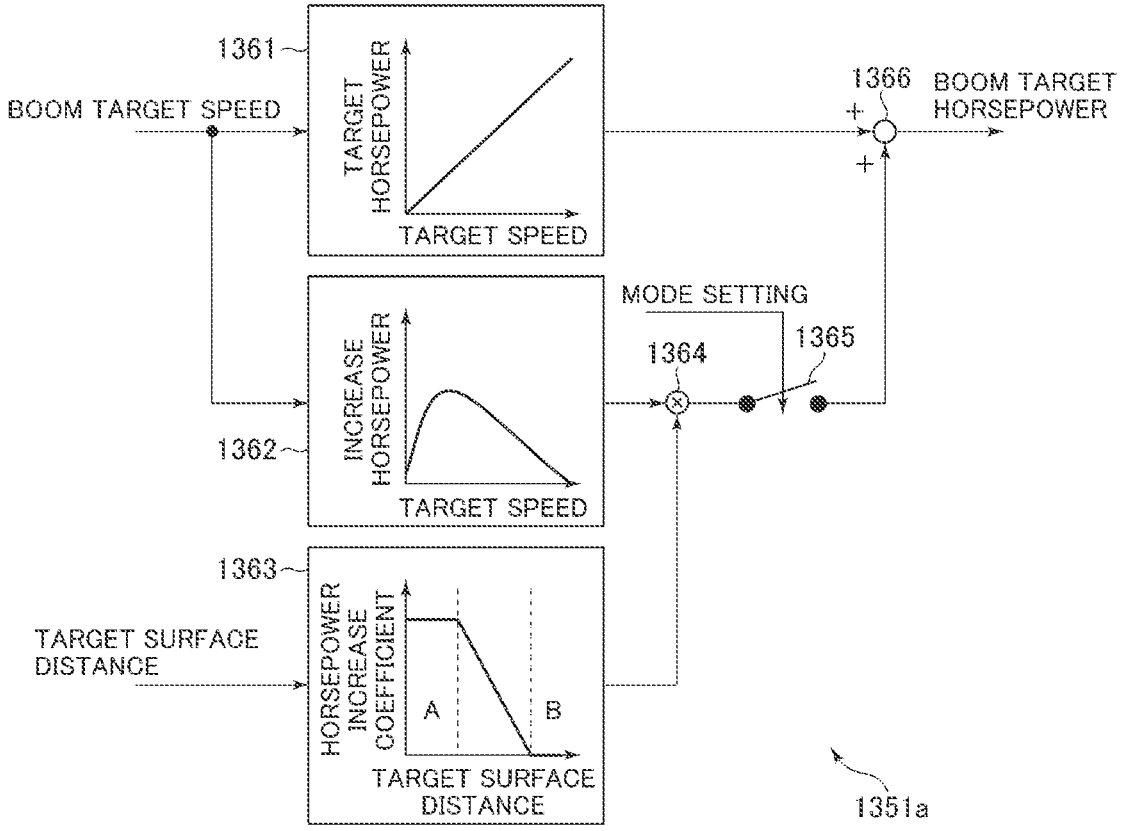
FIG. 11 is a control block diagram illustrating another example of computation of a boom raising target horsepower table of a main controller constituting a control system for a hydraulic construction machine according to an embodiment of the present invention.

Next, an example of the target horsepower correction method in accordance with the horsepower adjustment signal and the target surface distance signal conducted by the boom raising target horsepower table 1351*a*, the arm crowding target horsepower table 1351*c*, and the arm dumping target horsepower table 1351*d* will be described in detail with reference to the drawings. FIG. 10 is a control block diagram illustrating an example of the computation of the boom raising target horsepower table of the main controller constituting a control system for a hydraulic construction machine according to an embodiment of the present invention, and FIG. 11 is a control block diagram illustrating another example of the computation of the boom raising target horsepower table of the main controller constituting a control system for a hydraulic construction machine according to an embodiment of the present invention.

The correction methods executed by the boom raising target horsepower table 1351*a*, the arm crowding target horsepower table 1351*c*, and the arm dumping target horsepower table 1351*d* are similar to each other, so that solely the correction method executed by the boom raising target horsepower table 1351*a* will be described, and a description of the correction methods executed by the arm crowding target horsepower table 1351*c* and the arm dumping target horsepower table 1351*d* will be left out.

FIG. 10 illustrates the method of correcting the target horsepower in accordance with the horsepower adjustment signal and the target surface distance signal. In FIG. 10, the boom raising target horsepower table 1351*a* is equipped with a boom raising target horsepower table 1361, a boom raising increase horsepower table 1362, a horsepower increase coefficient table 1363, a multiplication section 1364, an addition section 1366, and a variable gain multiplication section 1367.

The boom raising target horsepower table 1361 inputs the boom target speed signal, and computes a boom raising target horsepower signal in accordance with the boom target speed signal by a previously set table, and outputs it to the addition section 1366. Similarly, the boom raising increase horsepower table 1362 inputs the boom target speed signal, and computes a boom raising increase horsepower signal in accordance with the boom target speed signal by a previously set table, and outputs it to the multiplication section 1364.

The horsepower increase coefficient table 1363 inputs the target surface distance signal, and computes a horsepower increase coefficient signal in accordance with the target surface distance signal by a previously set table, outputting it to the multiplication section 1364. The multiplication section 1364 multiplies the boom raising increase horsepower signal by the horsepower increase coefficient signal to calculate the boom horsepower correction value signal, and outputs it to the variable gain multiplication section 1367.

The variable gain multiplication section 1367 inputs the horsepower adjustment signal and the boom horsepower correction value signal, and outputs to the addition section 1366 a correction signal obtained by multiplying a horsepower adjustment gain between 0 and 1 in accordance with the horsepower adjustment signal by the boom horsepower correction value signal. The addition section 1366 adds the boom raising target horsepower signal before correction and the correction value signal together, and outputs the result, for example, to the maximum value selection section 1352*a* as a new boom raising target horsepower signal.

Here, the horsepower increase coefficient table 1363 is set such that the horsepower increase coefficient signal increases when the target surface distance signal is equal to or less than a target surface distance B, and that the horsepower increase coefficient signal is of the maximum value when the target surface distance signal is a target surface distance A. As a result, the smaller the target surface distance signal, the larger the target horsepower signal is corrected to be. As described above, it is desirable for the target surface distance A to be set to a distance of the construction accuracy equal to or better than that required for the operation. As described above, the target surface distance B is set based on the time elapsing until the work device 15 reaches the construction target surface through the arm operation. For example, it is set to a distance equal to or more than the distance obtained by multiplying the maximum value of the speed of the work device 15 due to the arm crowding by the control cycle of the main controller 100.

The increase horsepower table 1362 is set so as to decrease the boom raising increase horsepower signal as the target speed signal increases so that even in the case where the horsepower increase coefficient signal is of the maximum value, the corrected boom target horsepower signal will increase monotonously with respect to the target speed signal. However, in order that the boom target horsepower signal becomes 0 in the case where the target speed is 0, the increase horsepower table 1362 is set such that the boom raising increase horsepower signal also becomes 0 at least when the target speed signal is 0.

Next, the method of correcting the target horsepower in accordance with the mode setting signal and the target surface distance signal will be described with reference to FIG. 11. The portions that are the same as those in the case where the horsepower adjustment signal is used are indicated by the same reference numeral, and a description thereof will be left out. The following description will be restricted to the difference.

As in the case where the horsepower adjustment signal shown in FIG. 10 is used, after the boom horsepower correction value signal is computed by the multiplication section 1364, the boom horsepower correction value signal is outputted not to the variable gain multiplication section 1367 but to the connection section 1365. The connection section 1365 inputs the boom horsepower correction value signal and the mode setting signal. Only in the case where the mode setting signal is in either 2: the horsepower increase mode or 4: horsepower increase+locus control mode, the connection section is placed in the connection state, and the boom horsepower correction value signal is outputted to the addition section 1366.

In the case where the mode setting signal is 2: horsepower increase mode or 4: horsepower increase+locus control mode, the addition section 1366 adds together the boom raising target horsepower signal before correction and the boom horsepower correction value signal, and outputs the result, for example, to the maximum value selection section 1352*a* as a new boom raising target horsepower signal.

By performing the above computation, in the case where the mode setting is 1: normal mode, the horsepower correction value signal shown in FIG. 11 is not added, and a pump flow rate and a pump horsepower in accordance with the operation amount can be obtained, so that it is possible to achieve an energy saving property equivalent to that of the prior art.

In the case where the mode setting is 2: horsepower increase mode or 4: horsepower increase+locus control mode and where the work device 15 performs excavating at a position relatively spaced away from the construction target surface, the output signal from the horsepower increase coefficient table 1363 is 0, and the boom horsepower correction value signal that is the output of the multiplication section 1364 is 0, so that it is possible to achieve an energy saving property equivalent to that of the prior art. On the other hand, in the case where the work device 15 performs excavating at a position relatively close to the construction target surface, the boom horsepower correction value signal that is the output of the multiplication section 1364 is added, so that solely the pump horsepower signal is increased by correction. As a result, even if the excavating load increases, it is possible to achieve predetermined finish accuracy.

In the case where the mode setting is 2: horsepower increase mode and where no construction target surface is transmitted from the information controller 200, the input of the horsepower increase coefficient table 1363 is regarded as 0, so that the boom horsepower correction value signal that is the output of the multiplication section 1364 is added, so that solely the pump horsepower signal is increased by correction. As a result, even if the excavating load increases, it is possible to achieve predetermined finish accuracy.

Figure 12A:
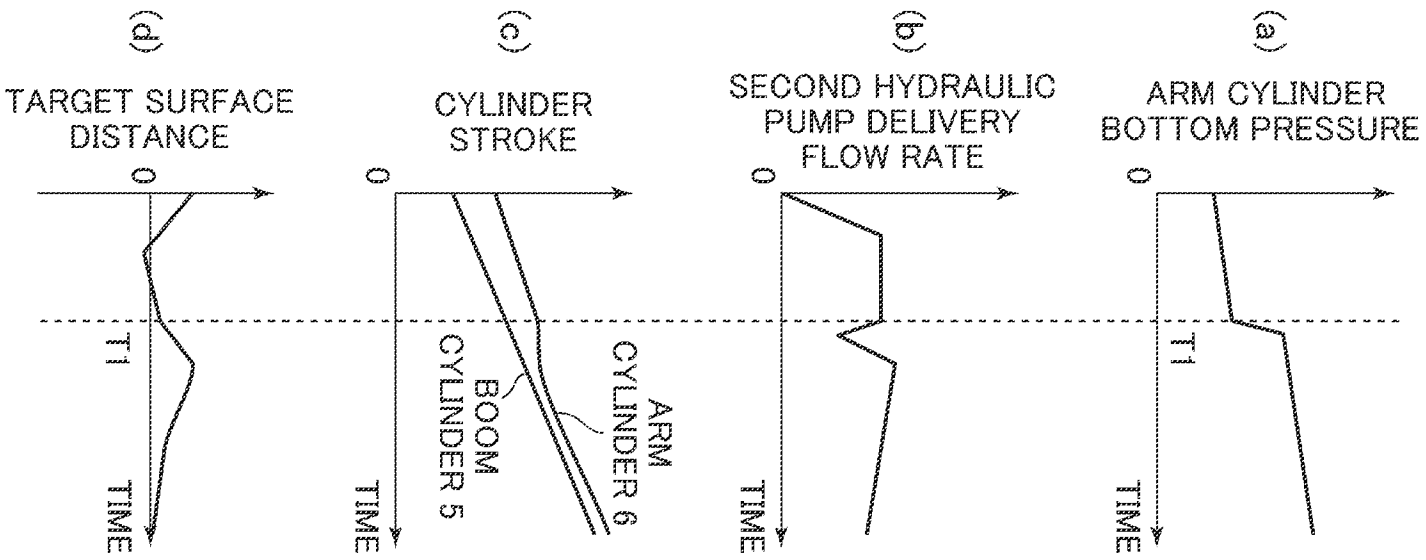
FIG. 12A is a characteristic chart illustrating an example of a time series operation of a hydraulic construction machine with a control system for a hydraulic construction machine according to an embodiment of the present invention.

Next, the operation of the control system for the hydraulic construction machine according to an embodiment of the present invention will be described with reference to the drawings. FIG. 12A is a characteristic chart illustrating an example of a time series operation of a hydraulic construction machine with a control system for a hydraulic construction machine according to an embodiment of the present invention, and FIG. 12B is a characteristic chart illustrating another example of a time series operation of a hydraulic construction machine with a control system for a hydraulic construction machine according to an embodiment of the present invention.

Figure 12B:
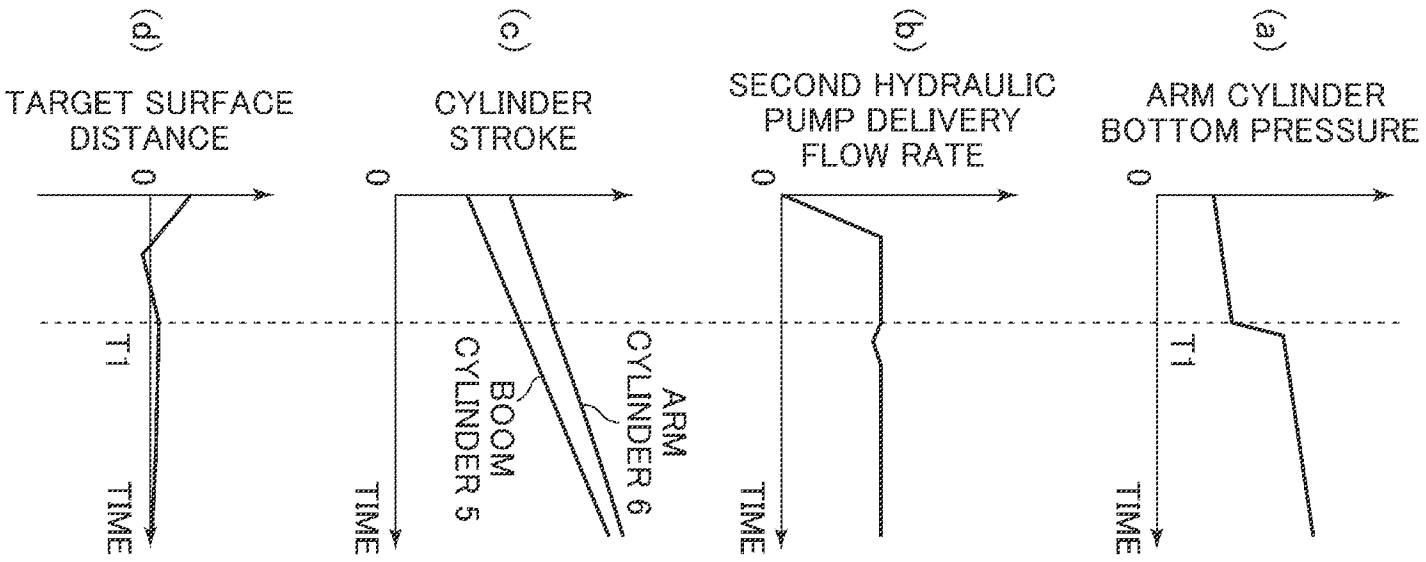
FIG. 12B is a characteristic chart illustrating another example of a time series operation of a hydraulic construction machine with a control system for a hydraulic construction machine according to an embodiment of the present invention.

FIG. 12A shows an example of the case where the horsepower adjustment signal is minimum and where the mode setting is 3: locus control mode, and FIG. 12B shows an example of the case where the horsepower adjustment signal is maximum and where the mode setting is 4: horsepower increase+locus control mode. In other words, FIG. 12A shows a case where almost no increase horsepower correction of the hydraulic pump is effected, and FIG. 12B shows a case where increase horsepower correction of the hydraulic pump is effected.

In FIGS. 12A and 12B, the horizontal axis indicates time, and the vertical axis indicates (a) the arm cylinder bottom pressure, (b) the second hydraulic pump delivery flow rate, (c) the arm cylinder stroke and the boom cylinder stroke, and (d) the target surface distance. The target surface distance is the distance between the work device 15 and the target construction surface. Time T1 indicates the time when the bottom pressure of the arm cylinder 6 abruptly increases due to an increase in the excavating load.

In FIG. 12A, when horizontally leveling operation is started at time 0, the delivery flow rate of the second hydraulic pump 22 that supplies the hydraulic fluid to the arm cylinder 6 increases as shown in portion (b). At the same time, the hydraulic fluid is supplied from the first hydraulic pump 21 to the boom cylinder 5, so that as shown in portion (c), the cylinder strokes of the boom cylinder 5 and the arm cylinder 6 increase.

Further, the mode setting is 3: locus control mode, so that the boom target speed and the arm target speed are adjusted by the target speed correction section 170, and, as shown in portion (d), the target surface distance is maintained around 0.

When, at time T1, the arm cylinder bottom pressure is abruptly increased due to an increase in the excavating load as shown in portion (a), the second regulator 28 reduces the delivery flow rate of the second hydraulic pump 22 in response thereto as shown in portion (b). As a result, as shown in portion (c), the cylinder stroke of the arm cylinder 6 stagnates, and the balance between the boom speed and the arm speed is lost. As a result, as shown in portion (d), the target surface distance increases. In other words, the work device 15 departs from the target construction surface.

Next, the case of FIG. 12B will be described. In FIG. 12B also, a similar operation is performed up to time T1. At time T1, even in the case where the arm cylinder bottom pressure is abruptly increased due to an increase in the excavating load as shown in portion (a), the second regulator 28 does not cause the delivery flow rate of the second hydraulic pump 22 to be greatly reduced in response thereto as shown in portion (b). This is due to the fact that the horsepower adjustment signal is maximum, that the mode setting is 4: horsepower increase+locus control mode, and that the pump horsepower is previously increased by correction.

As a result, as shown in portion (c), the cylinder stroke of the arm cylinder 6 does not stagnate, and the balance between the boom speed and the arm speed is maintained. As a result, as shown in portion (d), the target surface distance is controlled to a level around 0, and the work device 15 does not depart from the target construction surface.

In the control system for the hydraulic construction machine according to the embodiment of the present invention described above, the pump horsepower is correction-controlled in accordance with the distance between the work device 15 and the construction target surface, so that in the case where the work device 15 performs excavating at a position close to the construction target surface, it is possible to achieve predetermined finish accuracy even if the excavating load increases.

Further, in the control system for the hydraulic construction machine according to the embodiment of the present invention described above, there is provided a setting device allowing selection or adjustment as to which of energy saving property and speed follow-up property is to be given priority, and the pump horsepower is correction-controlled in accordance with the mode setting of the setting device, so that in the case where the work device 15 performs excavating at a position close to the construction target surface, it is possible to achieve predetermined finish accuracy even if the excavating load increases.

The present invention is not restricted to the embodiment described above but includes various modifications. For example, while the above embodiment has been described in connection with the boom cylinder 5 and the arm cylinder 6, this should not be construed restrictively.

Further, while the above embodiment has been described in detail in order to facilitate the understanding of the present invention, the present invention is not always restricted to a construction equipped with all the components described above.

DESCRIPTION OF REFERENCE CHARACTERS

5: Boom cylinder
6: Arm cylinder
21: First hydraulic pump
22: Second hydraulic pump
27: First regulator
28: Second regulator
32: Mode setting switch
100: Main controller
150: Target surface distance acquiring section
134: Pump flow rate control section
135: Pump horsepower control section

The invention claimed is:

1. A control system for a hydraulic construction machine, comprising:

a hydraulic actuator;

a work device including a boom, an arm, and a bucket driven by the hydraulic actuator;

a hydraulic pump supplying a hydraulic fluid to the hydraulic actuator;

a controller configured to control a delivery flow rate of the hydraulic pump and a horsepower of the hydraulic pump and to measure or compute a target surface distance that is a distance between a construction target surface on which the work device works and the work device, wherein the controller is configured to perform control such that as the target surface distance decreases, the delivery flow rate decreases, and to perform control such that as the target surface distance decreases, the horsepower of the hydraulic pump increases, wherein the hydraulic actuator is one of a plurality of hydraulic actuators including a boom driving actuator for driving the boom;

wherein there is provided a boom angle acquiring device acquiring an angle of the boom with respect to a horizontal plane, and wherein the controller is configured to perform control such that as the angle of the boom with respect to the horizontal plane acquired by the boom angle acquiring device decreases, the horsepower distributed to the boom driving actuator is more increased than the horsepower distributed to the hydraulic actuators other than the boom driving actuator.

2. A control system for a hydraulic construction machine, comprising:

a hydraulic actuator;

a work device including a boom, an arm, and a bucket driven by the hydraulic actuator;

a hydraulic pump supplying a hydraulic fluid to the hydraulic actuator;

a controller configured to control a delivery flow rate of the hydraulic pump and a horsepower of the hydraulic pump and to measure or compute a target surface distance that is a distance between a construction target surface on which the work device works and the work device, wherein the controller is configured to perform control such that as the target surface distance decreases, the delivery flow rate decreases, and to perform control such that as the target surface distance decreases, the horsepower of the hydraulic pump increases, wherein the controller comprises a correction table that maximizes and outputs a horsepower correction amount of the hydraulic pump when the target surface distance is equal to or less than a threshold value that is a value of construction accuracy equal to or better than that required, and wherein the controller is configured to correct the horsepower of the hydraulic pump in accordance with the output of the correction table.

* * * * *